United States Patent [19]

Hori et al.

[11] 4,175,144

[45] Nov. 20, 1979

[54] METHOD FOR SURFACE TREATMENT OF ELECTRODE IN DISTRIBUTOR OF INTERNAL COMBUSTION ENGINE FOR SUPPRESSING NOISE

[75] Inventors: Osamu Hori; Katsumi Kondo, both of Toyota, Japan

[73] Assignee: Toyota Jidosha Kogyo Kabushiki Kaisha, Toyota, Japan

[21] Appl. No.: 862,091

[22] Filed: Dec. 19, 1977

[30] Foreign Application Priority Data

Sep. 30, 1977 [JP] Japan ..... 52-116617

[51] Int. Cl.[2] ..... B05D 5/12; H01H 1/02; H01H 19/00

[52] U.S. Cl. ..... 427/126; 427/101; 427/103; 427/372 A; 427/419 B; 427/427; 200/267; 200/268; 200/19 R; 200/19 DR

[58] Field of Search ..... 200/267, 268, 19 R, 200/19 DC, 19 DR, 19; 148/6.35, 6.31; 427/34, 58, 123, 126, 101, 103, 372 A, 462, 465, 419 B, 423

[56] References Cited

U.S. PATENT DOCUMENTS

| | | | |
|---|---|---|---|
| 3,992,230 | 11/1976 | Komiyama et al. | 427/126 |
| 4,007,342 | 2/1977 | Makino et al. | 200/19 |
| 4,039,787 | 8/1977 | Hori et al. | 200/19 DR |
| 4,074,090 | 2/1978 | Hayashi et al. | 200/19 DR |
| 4,077,378 | 3/1978 | Okumura | 200/19 DR |

FOREIGN PATENT DOCUMENTS

| | | | |
|---|---|---|---|
| 2250268 | 4/1974 | Fed. Rep. of Germany | 200/19 DR |

*Primary Examiner*—Michael F. Esposito
*Assistant Examiner*—Richard Bueker
*Attorney, Agent, or Firm*—Stevens, Davis, Miller & Mosher

[57] ABSTRACT

An electrode for a spark discharge in a distributor is surface treated by using a spray coating process so as to provide the electrode with a surface layer of an electrically high resistive material, e.g. CuO, which surface layer further includes a predetermined percentage of refractory and electrical insulating material, e.g. $Al_2O_3$, $SiO_2$ or $MgO \cdot Al_2O_3$. A distributor having one such treated electrode for the distributor rotor and/or such treated electrodes for stationary terminals can exhibit stably-suppressed noise for over a long period of time.

5 Claims, 12 Drawing Figures

Fig. 1
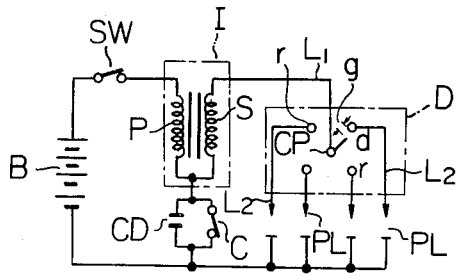
Fig. 2-a
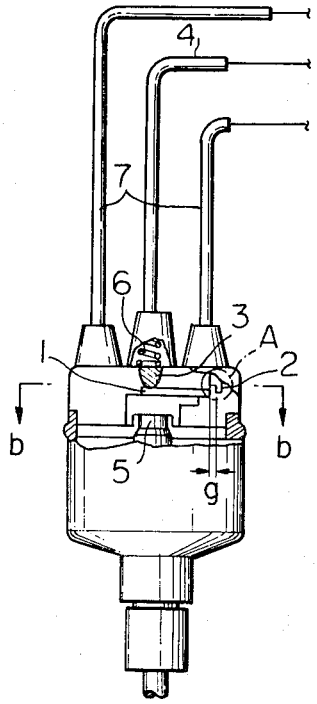
Fig. 2-b
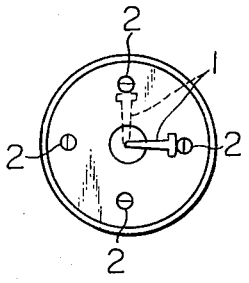

Fig. 3-a
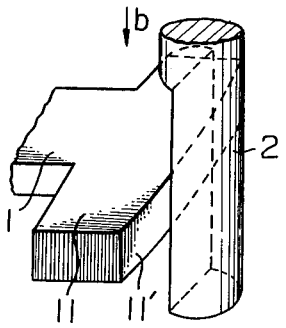
Fig. 3-b
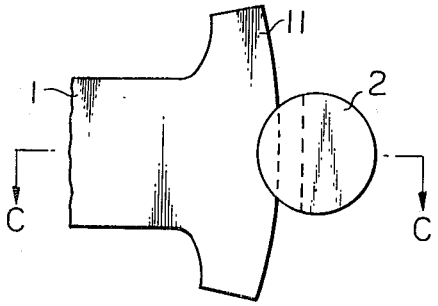
Fig. 3-c
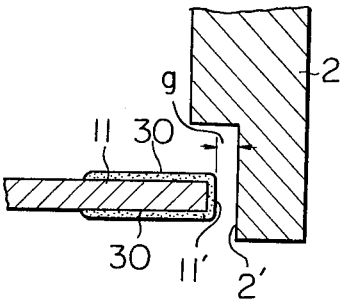
Fig. 4-c
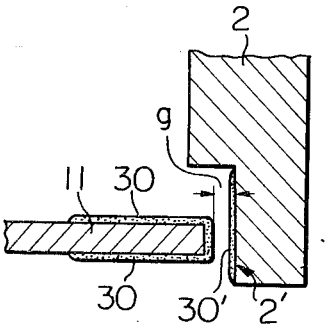

Fig. 7-H
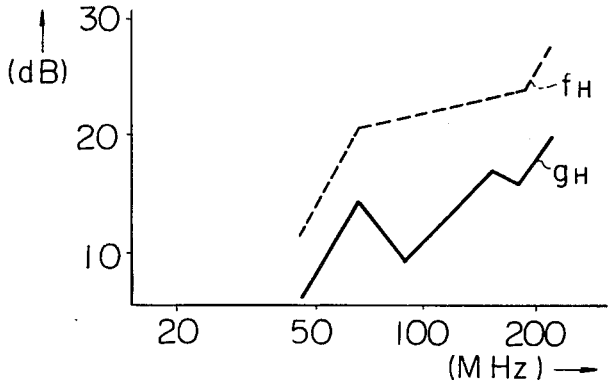
Fig. 7-V
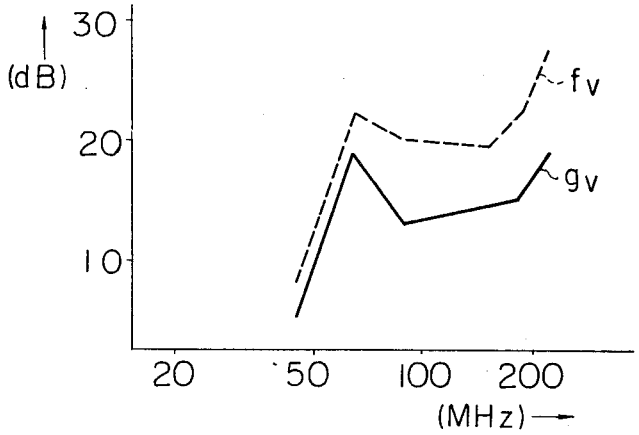

METHOD FOR SURFACE TREATMENT OF ELECTRODE IN DISTRIBUTOR OF INTERNAL COMBUSTION ENGINE FOR SUPPRESSING NOISE

The present invention relates to methods for treating the surface of the electrode of only the distributor rotor, or for treating the surface of all of the electrodes of only the stationary terminals, or for treating the surface of all of the electrodes in a distributor of an internal combustion engine for suppressing the noise generated from the distributor. More particularly, this invention relates to methods for forming a layer of an electrically high resistive material onto a surface of the electrode or surfaces of the electrodes.

For the purpose of suppressing noise caused by a spark discharge in the distributor various kinds of apparatuses or devices have been proposed. However, most of the proposed apparatuses or devices are too expensive for practical use in mass-produced vehicles. Furthermore, these apparatuses or devices are not, in practice, reliable. In the prior art, there are three kinds of typical apparatuses for suppressing radio interference noise. The first kind of apparatus is a resistor which is S-, L- or K-shaped and attached to the external terminal of the spark plug. In some cases, the resistors are contained in the spark plugs and hence are called resistive spark plugs. The second kind of apparatus is also a resistor which is inserted into one portion of the high tension cable and hence is called a resistive high tension cable. The third type of apparatus is a noise-suppressing capacitor. The above-mentioned prior art apparatuses for suppressing noise are, however, defective in that although they can suppress noise to a certain intensity level, that intensity level is still above the noise level which must be suppressed in the fields of broadcasting service systems, radio communication systems and electronic-controlled vehicle control systems. Moreover, the known noise-suppressing capacitor has no effect on high-frequency noises.

In the copending application, U.S. Patent Application Ser. No. 566,935, now U.S. Pat. No. 4,007,342, an improved distributor with a suppressed noise emission is disclosed, wherein either or both of the electrodes of the rotor and the electrode of each stationary terminal have a surface layer formed of an electrically high resistive material.

Furthermore, in the copending application, U.S. Patent Application Ser. No. 588,051, now U.S. Pat. No. 3,992,230 a method for treating the surface of the electrode in the distributor in the internal combustion engine, wherein a finely powdered electrically high resistive material is applied onto a surface of the electrode using a technique for spraying high melting materials, such as a "plasma arc coating process", a "thermo-spraying process" or a "detonation process". The finely powdered electrically high resistive material can be made from powdered CuO, NiO, $Cr_2O_3$, Si or $VO_2$. Other materials having higher electrical resistances of about $10^{13}$ to $10^{15}$ Ωcm, such as alumina, may also be used. Above all, CuO is the best material for use as the electrically high resistive material from an economic view and with regard to a satisfactory suppression of noises.

Howver, it was found that the distributor, comprised of both the rotor and stationary terminals either or both of which have a CuO-coated electrode, exhibits a defect in which the noise suppressing capability is gradually decreased during operation of the distributor in the vehicle for over a very long period of time.

Therefore, it is an object of the present invention to provide a method for treating the surface of the electrode in the distributor of the internal combustion engine for the purpose of suppressing noise, and more specifically, to provide a method for forming the electrically high resistive material layer on the surface of the electrode. Such method is useful for producing a distributor which can maintain the noise suppressing capability at a desired high level for over a very long period of time.

The present invention will be more apparent from the ensuing description with reference to the accompanying drawings wherein:

FIG. 1 is a typical conventional wiring circuit diagram of an igniter;

FIG. 2-*a* is a side view, partially cut off, showing a typical distributor utilized in the present invention;

FIG. 2-*b* is a sectional view taken along the line b—b of FIG. 2-*a;*

FIG. 3-*a* is a perspective view of electrodes for producing a spark discharge utilized in the present invention;

FIG. 3-*b* is a plan view seen from the arrow b of FIG. 3-*a;*

FIG. 3-*c* is a sectional view taken along the line c—c of FIG. 3-*b;*

FIG. 4-*c* is a sectional view taken along the line c—c of FIG. 3-*b* in accordance with a modified embodiment of the electrodes for producing a spark discharge;

Figure 8:
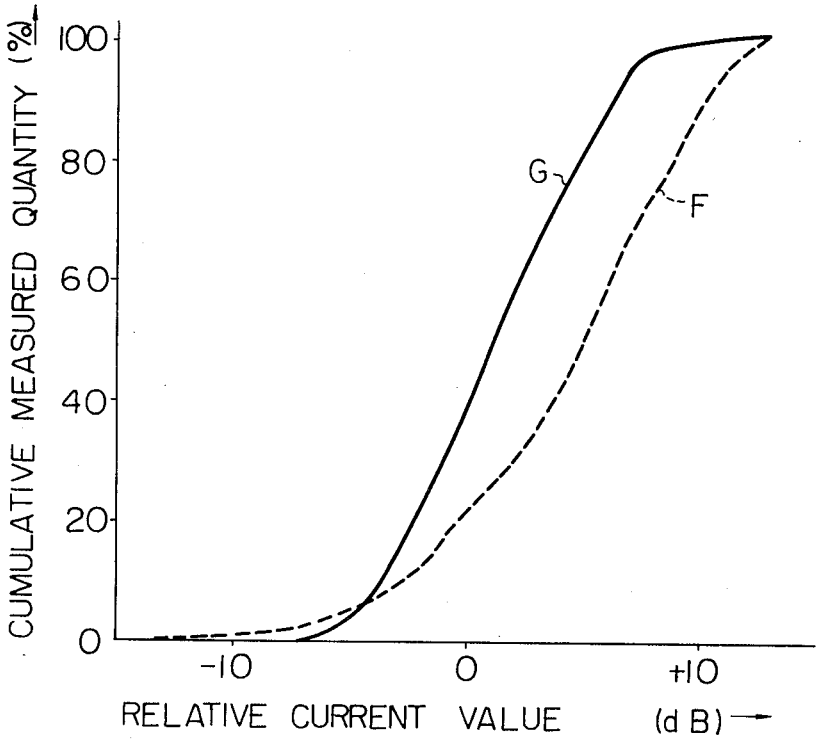

FIGS. 7-H and 7-V are graphs showing changes of the noise-field intensity level (in dB) of the horizontal polarization and the vertical polarization, respectively, which are produced by the igniter of the prior art and the igniter provided in the copending application U.S. Pat. Application Ser. Nos. 566,935 and 588,051, with respect to a detected frequency (in MHz) and;

FIG. 8 is a graph illustrating the noise-suppressing capability of a distributor according to the present invention.

FIG. 1 is a typical conventional wiring circuit diagram of the igniter, the construction of which depends on the well known battery-type ignition system. In FIG. 1, a DC (direct current) current which is supplied from the positive terminal of a battery B flows through an ignition switch SW, a primary winding P of an ignition coil I and a contact point C which has a parallelly connected capacitor CD, to the negative terminal of the battery B. When the distributor cam (not shown) rotates in synchronization with the rotation of the crankshaft located in the internal combustion engine, the distributor cam cylindrically opens and closes the contact point C. When the contact point C opens quickly, the primary current suddenly stops flowing through the primary winding P. At this moment, a high voltage is electromagnetically induced through a secondary winding S of the ignition coil I. The induced high-voltage surge, which is normally 10–30 (KV) leaves the secondary coil S and travels through a primary high tension cable $L_1$ to a center piece CP which is located in the center of the distributor D. The center piece CP is electrically connected to the distributor rotor d which rotates with the rotational period synchronized with said crankshaft. Four stationary terminals r, assuming that the engine has four cylinders, in the distributor D are arranged with the same pitch along a circular locus which is defined by the rotating electrode of the rotor d, maintaining a small gap g between the electrode of the stationary terminals and the circular locus. The induced high-voltage surge is further fed to the stationary terminals r through the small gap g each time the electrode of the rotor d comes close to one of the four stationary terminals r. Then, the induced high-voltage surge leaves one of the terminals r and further travels through a secondary high tension cable $L_2$ to a corresponding spark plug PL, where a spark discharge occurs in the corresponding spark plug PL and ignites the fuel air mixture in the corresponding cylinder.

It is a well-known phenomenon that noise is radiated with the occurrence of a spark discharge. As can be seen in FIG. 1, three kinds of spark discharges occur at three portions in the igniter, respectively. A first spark discharge occurs at the contact point C of the contact breaker. A second spark discharge occurs at the small gap g between the electrode of the rotor d and the electrode of the terminal r. And a third spark discharge occurs at the spark plug PL. In various kinds of experiments, the inventors discovered that, among the three kinds of spark discharges, although the first and third spark discharges can ordinarily be suppressed by the capacitor and resistive spark plug, respectively, the second spark discharge, which occurs at the small gap g between the electrode of the rotor d and the electrode of the terminal r, still radiates the loudest noise compared with the othe two. This is because the second spark discharge includes a spark discharge, the pulse width of which is extremely small and the discharge current of which is extremely strong. This spark discharge radiates the loudest noise from the high tension cables $L_1$ and $L_2$, which act as antennas.

Although the reason for the production of a spark discharge having an extremely small pulse width and an extremely large discharge current has already been explained in detail in the copending application U.S. Patent Application Ser. No. 470,974, now U.S. Pat. No. 3,949,721, a brief summary of such reason will be offered here. In FIG. 1, the high voltage of the induced high voltage surge from the secondary winding S appears at the rotor d not as a step-like wave, but as a wave in which a voltage at the rotor d increases and reaches the high voltage gradually with a time constant the value of which is mainly decided by the circuit constant of the ignition coil I and the primary high tension cable $L_1$. When the voltage which appears at the rotor d increases and reaches a sufficient voltage, it causes a spark discharge at the gap g between the electrodes of the rotor d and the terminal r, and, at the same time, the electric charge which has been charged to a distributed capacity along the primary high tension cable $L_1$, attains a distributed capacity along the secondary high tension cable $L_2$ through the present spark discharge, which is generally called a capacity discharge. Thereafter, the so-called inductive discharge occurs. A voltage level along the primary high tension cable $L_1$ momentarily decreases when the capacity discharge occurs. However, immediately after the capacity discharge occurs, a voltage at the spark plug PL gradually increases with a certain time constant, and when the voltage reaches an adequate level, the spark discharge occurs at the spark plug PL. Thereby, one ignition process is completed. Thus, a spark discharge current, which flows through the small gap g, is produced in accordance with the capacitive discharge and the inductive discharge, respectively. Above all the strongest noise accompanied by deleterious high frequencies has been found in connection with the capacity discharge which includes discharge pulses having an extremely small pulse width and an extremely strong discharge current. Therefore, the wave of the capacity discharge current must be transformed into a wave with a relatively large pulse width and a relatively small discharge current. Thereby, the deleterious high frequency components are considerably decreased because of the stabilized capacity discharge current by the above-mentioned transformation of the wave. For the purpose of realizing the above-mentioned transformation of the wave, an electrically high resistive material disposed on the electrode is very useful.

In FIGS. 2-*a* and 2-*b*, 1 indicates a distributor rotor (corresponding to d in FIG. 1), and 2 indicates a stationary terminal (corresponding to r in FIG. 1). The electrode of rotor 1 and the electrode of terminal 2 face each other with the small gap g (FIG. 2-*a*) between them.

A center piece 3 (corresponding to CP in FIG. 1) touches the inside end portion of the rotor 1. The induced high voltage surge at the secondary winding S (FIG. 1) travels through a primary high tension cable 4 (corresponding to $L_1$ in FIG. 1) and through the center piece 3 to the electrode of the rotor 1. A spring 6 pushes the center piece 3 downward to the rotor 1, thereby making a tight electrical connection between them. At the time when the electrode of the rotor 1, which is indicated by the solid line in FIG. 3-*b*, faces the terminal 2, the high voltage surge is fed to the terminal 2 through a spark discharge and is applied to the corresponding spark plug PL (FIG. 1) through a secondary high tension cable 7 (corresponding to $L_2$ in FIG. 1), where the fuel air mixture is ignited in the corresponding cylinder. When the rotor 1 rotates to the position indicated by the dotted line in FIG. 3-*b*, and the electrode of the rotor 1 faces the next terminal 2, the high voltage surge is fed to the next terminal 2 through a spark discharge and is applied to the next corresponding spark plug PL (FIG. 1) through the other secondary high tension cable 7. In a similar way, the high voltage surge is sequentially distributed.

FIGS. 3-*a*, 3-*b* and 3-*c* show enlarged views of electrodes of the distributor rotor and the stationary terminal used in the present invention, which correspond to the members contained in circle A which is indicated by the dotted chain line in FIG. 2-*a*. In FIG. 3-*a*, the reference numeral 11 indicates the electrode which is formed as a part of rotor 1 as one body and is T-shaped. A front surface 11' of the electrode 11 faces a side surface 2' (FIG. 3-*c*) of the terminal 2 with a spark discharging gap g. Both the front surface 11' and the side surface 2' act as electrodes for the spark discharge. The reference numeral 30 (FIG. 3-*c*) indicates the electrically high resistive material layer which is formed on the electrode by the method according to the present invention described in detail later. It should be noted that an electrically high resistive material layer can also be formed on both the electrodes 2' and 11 as shown by the numerals 30 and 30' in FIG. 4-c, or only on the electrode 2'. Accordingly, it is possible to form electrically high resistive material layers on the electrode 11 and/or on the electrode 2'.

Figure 5:
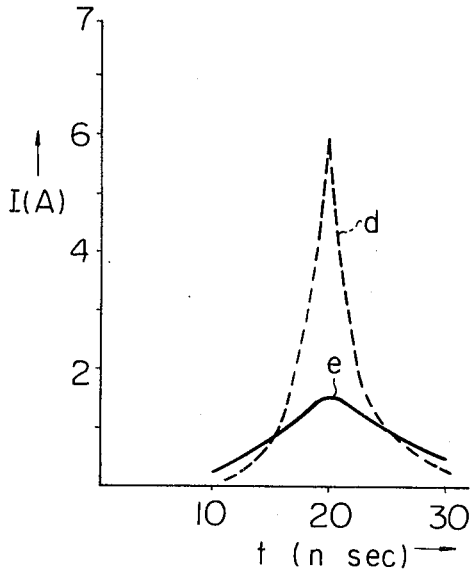
FIG. 5 is a graph showing changes of the current flow (in A), which is the so-called capacity discharge current in the igniter with an electrically high resistive material layer and in an igniter without such layer with respect to time (in nsec)

FIG. 2 is a graph illustrating the effect of the electrically high resistive material layer upon reducing the capacity discharge current. In FIG. 5 the wave form indicated by the solid line e and the one indicated by the dotted line d show the changes of the capacity discharge current when using and when not using the electrically high resistive material layer, respectively. In FIG. 5, the coordinates indicate a capacity discharge current I (in A), and time (in nsec). It should be apparent from FIG. 5 that the maximum capacity discharge current I is remarkably reduced and, at the same time, both the pulse width and the rise time of the capacity discharge current are expanded by forming the electrically high resistive material layer on the electrodes 11 and/or 2'. A capacity discharge current which includes deleterious high frequency components and thus radiates a strong noise, can be transformed into a capacity discharge current which has almost no deleterious high frequency components, and only a slight noise, by applying the electrically high resistive material layer to the electrode.

The reason the above-mentioned transformation of the capacity discharge current wave form can be accomplished is not known, but it is possible that a normal discharge at the spark discharging gap g between the electrodes 11 and 2' does not occur because of the intervention of the electrically high resistive material layer 30 (30') which lies therebetween, thus interrupting the flow of the discharge current.

As mentioned above, both the rise time and the pulse width of the capacity discharge current are expanded by providing only the electrically high resistive material layer between the spark discharging gap g, whereby the deleterious high frequency components and the accompanying strong noise can be both eliminated from the capacity discharge current.

Figure 6:
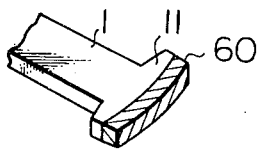
FIG. 6 is a perspective view of an electrode of the distributor rotor and shows the entire tip area on which an electrically high resistive material layer has been formed.

The electrically high resistive material layer 30 can be made of various kinds of metal oxides. Above all, as previously mentioned, CuO is the best metal oxide for the layer 30 from an economical viewpoint and in terms of the layer's capability for suppressing noise. The electrically high resistive material layer 30 was produced by for example, the following processes. An electrode 11 made of brass or steel (as shown in FIGS. 3-a through FIG. 4-c) was washed with trichlene, and the area of the electrode (the hatched area 60 as shown in FIG. 6) for applying a layer of CuO thereupon, was rendered uniformly coarse by a shot using blasting technique. Onto the area 60, particulate nickel aluminide was applied by using a plasma arc coating technique in order to enhance the adhesion between the electrode 11 and the CuO layer to be coated thereon. The nickel aluminide may have such a composition that it comprises 80 to 97% by weight of Ni and 20 to 3% by weight of Al. The most preferable nickel aluminide essentially consists of about 95.5% by weight of Ni and about 4.5% by weight of Al. Using a METCO 3 MBT plasma gun a trade name, finely powdered CuO was first sprayed onto the nickel aluminide layer and was then subjected to a plasma arc of an appropriate current, for example 400 (A), while the surface of the electrode was cooled with argon gas. Thereby, the electrically high resistive layer 30 made of CuO was obtained.

The distributor having the above-mentioned CuO-coated distributor rotor was included in a conventional vehicle and tested for the noise-field intensity level. FIGS. 7-H and 7-V are graphs illustrating the advantages of the distributor rotor having the CuO layer over the conventional distributor rotor having no electrically high resistive material layer, wherein the y and x coordinates of FIG. 7-H indicate a noise-field intensity of the horizontal polarization and the frequency at which the noise-field intensity is measured, respectively. The noise-field intensity is indicated in dB in which 0 (dB) corresponds to 1 ($\mu$V/m), and the frequency is indicated in (MHz). Furthermore, in FIG. 7-V the abscissa is the same as that in FIG. 7-H and the other coordinate indicates the noise-field intensity of the vertical polarization waves. In FIGS. 7-H and 7-V, measurements indicated by the solid lines $g_H$, $g_V$ and by the dotted lines $f_H$, $f_V$ were respectively obtained by using a vehicle which included a typical conventional resistive spark plug and a resistive high tension cable combined with the CuO layer and by using a vehicle which included only the typical conventional resistive spark plug and the resistive high tension cable. It should be quite clear from FIGS. 7-H and 7-V that the noise-field intensity produced from the igniter including the CuO layer is considerably minimized when compared to that of the conventional igniter, and it should be accordingly understood that the CuO layer remarkably suppresses the above-mentioned undesirable loud noise.

However, the inventors discovered that the noise suppressing capability of the CuO layer is gradually decreased if the distributor rotor having the CuO layer operates in the vehicle for an extensively long time. In other words, referring to FIGS. 7-H and 7-V, the characteristic curves indicated by the solid lines $g_H$ and $g_V$ gradually approach the characteristic curves indicated by the dotted lines $f_H$ and $f_V$, respectively. Thus, a stable noise suppressing capability due to the presence of the CuO layer cannot be maintained for over a very long time when the distributor rotor is operating in the vehicle.

As a result of carrying out various kinds of investigations for solving the above-described problem wherein the noise suppressing capability is decreased, the inventors discovered that a chemical change occurred in the CuO layer in a high temperature atmosphere. The chemical change can be described is as follows. CuO of the CuO layer changes its chemical state in a high temperature atmosphere such as one over about 1000° C. in accordance with the following reversible chemical reaction, that is:

$$CuO \rightleftarrows Cu_2O \rightleftarrows Cu$$

It should be noted, that in the above reversible chemical reaction, Cu has a very low electric resistance, and $Cu_2O$ also has a relatively low electric resistance. Therefore, the electrically high resistive material layer 30 comprised of CuO may be changed to an electrically low resistive material layer due to the presence of Cu or $Cu_2O$. As a result, referring to FIG. 5, the capacity discharge curent (indicated by the solid line e), which has almost no deleterious high frequency components, gradually changes to the capacity discharge current (indicated by the dotted line d), which has deleterious high frequency components. In this manner, the noise suppressing capability is thus gradually decreased.

The above-mentioned high temperature atmosphere such as over about 1000° C., which can reverse a chemical reaction, first occurs during the process whereby finely powdered CuO is sprayed onto the electrode 11 (FIGS. 3-*c* and 4-*c*) and is subjected to a plasma arc. Such high temperature occurs again in the spark discharging gap g (FIGS. 3-*c* and 4*c*) during when a spark is discharged between the electrode 11 and the electrode 2′ of each stationary terminal 2 while the vehicle is operating.

The inventors of the present invention undertook experiments wherein a part of the CuO in the CuO layer was replaced by a refractory in a high temperature atmosphere and by an electrical insulating material.

They discovered that the noise suppressing capability can be stably maintained at a desired high level over a very long time under a condition in which the CuO layer is comprised of both CuO and the refractory and electrical insulating material which are mixed at a particular predetermined mixing ratio. Due to this discovery, the CuO layer as specified in accordance with the present invention further comprises the refractory and electrical insulating material which is mixed with CuO at a predetermined mixing ratio.

According to the experiment, the refractory and electrical insulating material should preferably be selected from $Al_2O_3$, $SiO_2$, $Cr_2O_3$ and $MgO.Al_2O_3$. However, $Al_2O_3$ is especially preferable as the refractory and electrical insulating material from the viewpoints of economy and chemical stability. As for the stability of the noise suppressing capability, it varies in accordance with the mixing ratio between CuO and the selected refractory and electrical insulating material. For example, assuming that the refractory and electrical insulating material is made of $Al_2O_3$, it is most preferable to mix CuO and $Al_2O_3$ together according to the following mixing ratio by weight, that is:

$$CuO:Al_2O_3=60:40.$$

If the mixing ratio by weight is:

$$CuO:Al_2O_3=90:10,$$

by which ratio an excessive amount of CuO is contained in the CuO layer with respect to $Al_2O_3$ and wherein the CuO layer is considered to be mainly comprised of CuO such as in the CuO layer of the prior art, then the noise suppressing capability cannot be maintained stably over a very long time. On the other hand, if the mixing ratio by weight is:

$$CuO:Al_2O_3=50:50$$

or $$CuO:Al_2O_3=40:60,$$

by which ratio a relatively excessive amount of $Al_2O_3$ is contained in the CuO layer with respect to CuO, then a spark discharge will occur in the spark discharge gap g (FIG. 3-*c*) not by passing through the electrically high resistive material layer 30 (FIG. 3-*c*), that is the CuO layer, but by jumping over the CuO layer through the air. Accordingly, the spark discharge current flows directly from the electrode 11 to the electrode 2′ (FIG. 3-*c*). In this case, no noise suppressing capability can be attained, because the spark discharge current does not flow through the CuO layer. For verification, the inventors of the present application cut the electrode 11 along the line C—C (see FIG. 3-*b*) and examined the sectional view of the CuO layer which was formed by using the above mixing ratio of $CuO:Al_2O_3=50:50$ through a microscope and found that the sectional area occupied by CuO in the CuO layer was extremely small, about 10 to 20% of the total sectional area. However, it should be noted that the highest degree of the noise suppressing capability was obtained when CuO and $Al_2O_3$ were mixed at a mixing ratio very close to a limit of the mixing ratio at which the spark discharge occurs not by passing through the CuO layer but by jumping over the CuO layer. Therefore, as previously mentioned, the mixing ratio of $CuO:Al_2O_3=60:40$ is most preferable.

EXAMPLE

An electrode 11 (FIGS. 3-*a* and 3-*b*) made of brass was washed with trichlene, and the area of the electrode (the hatched area 60 as shown in FIG. 6) for applying a layer of electrically high resistive material thereon, was rendered uniformly coarse by using a hot blasting technique. Onto the area 60, nickel aluminide (METCO NO. 450), consisting essentially of 95.5% by weight of Ni and 4.5% by weight of Al, was applied by using a plasma arc coating technique to form a coating of 0.05 to 0.1 (mm) in thickness, in order to enhance the adhesion between the electrode 11 (FIG. 3-*c*) and the electrically high resistive material layer to be applied thereon. On the other hand, finely powdered CuO of a size of $-150+325$ mesh and finely powdered $Al_2O_3$ of a size of $-150$ mesh $+40\mu$ were mixed at a predetermined mixing ratio, that is $CuO:Al_2O_3=60:40$. Furthermore, the finely powdered CuO and $Al_2O_3$ were uniformly mixed by using a powder mixer. Then, using a METCO 3 MBT gun (a trade name), mixed CuO and $Al_2O_3$ coating of 0.1 to 0.5 (mm) in thickness was applied to the area 60 by using a plasma arc coating technique whereby a mixture of finely powdered CuO and $Al_2O_3$ was first sprayed onto the area 60 and then such coating was subjected to a plasma arc of 400 (A) while cooling the surface of the electrode 11 with air. Thereby, the electrically high resistive material layer 30 (FIG. 3-*c*) made of a mixture of CuO and $Al_2O_3$ was produced, on the electrode 11.

The distributor produced in accordance with the procedures of this example was included in a conventional vehicle and was tested with regard to the stability of the noise suppressing capability over a long period of time.

The results of the test are shown by the graph of FIG. 8. In FIG. 8, the ordinate indicates a cumulative measured quantity in (%), the abscissa indicates a relative current value in (dB) in which 0 (dB) corresponds to a predetermined reference value of the capacity discharge current (please refer to FIG. 5). When the predetermined reference value of the capacity discharge current was set to be 1.8 (A), the value $-10$ (dB) corresponded to about one third of the predetermined reference value, and the value $+10$ (dB) corresponded to about three times the predetermined reference value. Regarding the ordinate of the graph, the probability of the occurrences of various levels of the capacity discharge current is expressed in (%), wherein such probability is calculated by obtaining the cumulative measured quantity from measured values for, e.g., 1000 occurrences of regular spark discharges between electrodes 11 and 2' (FIG. 3-c). Noncumulative measured values are generally distributed in accordance with the so-called normal distribution. If a characteristic curve illustrated in the graph of FIG. 8 shows a steep rising slope and is also located closer to the left side of the graph, then the characteristic curve indicates a low probability in the occurrence of a capacity discharge current having a large amplitude. At the same time, such curve indicates a high probability in the occurrence of a capacity discharge current having small amplitude. Accordingly, the distributor which produces the above characteristic curve is the most preferable distributor for maintaining a stable noise suppressing capability over an extensive period of time. In FIG. 8, the curve F indicated by a dotted line shows the characteristic curve obtained by the distributor which contained a rotor having a CuO layer comprised of only CuO, while the curve G indicated by a solid line shows the characteristic curve obtained by the distributor which contained a rotor having a CuO layer comprised of a mixture of CuO and $Al_2O_3$ according to the example of the present invention. As apparent from the graph of FIG. 8, the curve G according to the present invention has a steeper rising slope than that of the curve F; also, the curve G is located, as a whole, to the left side of the graph than the curve F. Therefore, as previously explained, the CuO layer according to the present invention can maintain a stable and high noise suppressing capability for over a very long period of time.

In the above example, the mixing ratio by weight was set to be $CuO:Al_2O_3=60:40$. According to the experiment, the mixing ratio by weight may be set to be $$CuO:Al_2O_3=70:30 \quad (1)$$

or $$CuO:Al_2O_3=80:20. \quad (2)$$

The CuO layer having the mixing ratio shown in the above item (1) or (2) can also be effective for maintaining the stable and high noise suppressing capability for over a very long period of time. However, the effectiveness of the CuO layers defined by items (1) and (2) is relatively smaller than that of the CuO layer mentioned in the above Example. Furthermore, in the above Example, the refractory and electrical insulating material was selected to be $Al_2O_3$. However, it should be noted that $SiO_2$, $MgO.Al_2O_3$ and the like can also be utilized, in place of $Al_2O_3$, as a refractory and electrical insulating material. The CuO layer comprised of CuO and $SiO_2$ has the same effectiveness for maintaining the stable and high noise suppressing capability as the effectiveness obtained by the CuO layer mentioned in the above-described Example, wherein the mixing ratio by weight was selected to be $CuO:SiO_2=60:40$, and wherein finely powdered CuO and $SiO_2$ both having a size of lower than 150 mesh were uniformly mixed and sprayed on the area 60 (FIG. 6) by using a plasma arc coating technique.

The CuO layer comprised of CuO and $MgO.Al_2O_3$ can also be utilized, in place of $Al_2O_3$ as a refractory and electrical insulating material. This CuO layer has the same effectiveness for maintaining the stable and high noise suppressing capability as the effectiveness obtained by the CuO layer comprised of CuO and $Al_2O_3$ mentioned in the above Example, wherein the mixing ratio by weight was selected to be $CuO:MgO.Al_2O_3=80:20$, and wherein finely powdered CuO and $MgO.Al_2O_3$ both having a size of lower than 100 mesh were uniformly mixed and sprayed on the area 60 (FIG. 6) by using a plasma arc coating technique.

As described above, according to the present invention, the deleterious effect, wherein the CuO layer comprised solely of CuO is chemically changed in a high temperature atmosphere over 1000° C. and produces Cu and/or $CuO_2$ (both exhibiting a relatively low electrical resistance), can be overcome by further adding a refractory and electical insulating material at a predetermined mixing ratio to the CuO layer.

What is claimed is:

1. A method for the surface treatment of at least one electrode of both the distributor rotor and each stationary terminal in a distributor rotor of an internal combustion engine for suppressing noise, wherein finely powdered metal oxide comprising CuO and having a high electric resistance is applied onto said surface of said electrode by a coating process, wherein the improvement comprises:

adding a finely powdered refractory and electrical insulating material to said finely powdered metal oxide comprising CuO at a predetermined mixing ratio, uniformly mixing said finely powdered metal oxide comprising CuO and said finely powdered refractory and electrical insulating material together, and then applying the mixture onto said surface of said electrode by using a spray coating process.

2. A method as set forth in claim 1, wherein, $P_1$ being the percent by weight of said finely powdered CuO, and $P_2$ being the percent by weight of said finely powdered refractory and electrical insulating material, said CuO and said insulating material are uniformly mixed together and applied onto said electrode under the conditions of $P_1+P_2=100$, $80 \geqq P_1 \geqq 60$ and $40 \geqq P_2 \geqq 20$.

3. A method as set forth in claim 1, wherein said finely powdered refractory and electrical insulating material comprises $Al_2O_3$.

4. A method as set forth in claim 1, wherein said finely powdered refractory and electrical insulating material comprises $SiO_2$.

5. A method as set forth in claim 1, wherein said finely powdered refractory and electrical insulating material comprises $MgO.Al_2O_3$.

* * * * *